US006748828B2

(12) United States Patent
Bollinger

(10) Patent No.: US 6,748,828 B2
(45) **Date of Patent: *Jun. 15, 2004**

(54) MULTI-SIZED TOOL ADAPTER

(76) Inventor: Robert A. Bollinger, 410 W. 21st St., Lumberton, NC (US) 28358

( * ) Notice: Subject to any disclaimer, the term of this patent is extended or adjusted under 35 U.S.C. 154(b) by 257 days.

This patent is subject to a terminal disclaimer.

(21) Appl. No.: 09/907,974

(22) Filed: Jul. 18, 2001

(65) Prior Publication Data

US 2001/0042423 A1 Nov. 22, 2001

Related U.S. Application Data

(63) Continuation of application No. 09/566,788, filed on May 8, 2000, now Pat. No. 6,269,717.

(51) Int. Cl.[7] ..... B25B 23/16

(52) U.S. Cl. ..... 81/177.2; 81/124.4; 81/124.6; 81/125.1; 81/436

(58) Field of Search ..... 81/177.2, 124.4, 81/124.6, 125.1, 437, DIG. 11, 58.1, 436, 438

(56) References Cited

U.S. PATENT DOCUMENTS 5,148,724 A * 9/1992 Rexford ..... 81/124.4
5,186,083 A * 2/1993 Hsiao ..... 81/DIG. 11
5,943,924 A * 8/1999 Jarvis ..... 81/177.2
5,960,681 A * 10/1999 Anderson et al. ..... 81/124.6
5,970,826 A * 10/1999 Iwinski et al. ..... 81/124.6
6,367,356 B1 * 4/2002 Stepp ..... 81/177.2

* cited by examiner

*Primary Examiner*—James G. Smith
(74) *Attorney, Agent, or Firm*—Coats & Bennett P.L.L.C.

(57) ABSTRACT

A tool for receiving adapters and sockets of various sizes. One embodiment includes a first receiving end having outer and inner cavities being substantially rectangular with the inner cavity having a smaller diameter than the outer cavity. A second extension end is positioned opposite the first receiving end and includes outer and inner extensions being substantially rectangular shaped with the outer extension having a smaller width than the inner extension. Another embodiment includes a first end having at least two receiving cavities axially aligned. A first receiving cavity is positioned proximate the first end and has a larger diameter than a second distal receiving cavity. A second end includes at least two receiving cavities axially aligned including a third receiving cavity positioned proximate the second end having a larger diameter than a fourth distal receiving cavity.

11 Claims, 3 Drawing Sheets

MULTI-SIZED TOOL ADAPTER

The present application is a continuation of U.S. patent application Ser. No. 09/566,788, filed May 8, 2000, now U.S. Pat. No. 6,269,717.

FIELD OF THE INVENTION

The present invention relates generally to an adapter for receiving at least two separate sizes of tools and, more particularly, to an adapter having at least two sized cavities and/or extensions for mounting on a variety of different sized ratchets and other like tools.

BACKGROUND OF THE INVENTION

Socket wrenches, including a drive tool and socket, are commonly used to turn fasteners, such as nuts and bolts. A first end of the socket is placed over the bolt and the drive tool is inserted into a second socket end. A user then applies force directly to the drive tool for rotating the bolt.

A standard socket set includes a number of sockets each having different first end sizes for accommodating a variety of sizes of bolt heads and other like fasteners. Commonly, the sockets are dimensioned according to the common sizes of fasteners, such as the metric or English systems. The second socket end attaches to the drive tool and may have a variety of sizes, depending upon the manufacturer, year of manufacture, first socket end dimensions, and the like. Each of the second ends is substantially rectangular in shape, but there are no standardized sizes or dimensions.

A problem occurs for persons that use a variety of different sockets and drive tools. When working on fasteners of unknown or varying size, the user is required to have a variety of sockets to accommodate the fasteners, and a variety of drive tools to accommodate the socket second ends. This gets extremely burdensome for the user requiring them to carry numerous extra tools that may or may not be necessary. Additionally, different sized sockets may get mixed together within a tool box thereby requiring the user to always bring different sized drive tools to ensure they can accommodate the sockets.

Prior art designs have focused more on the first socket ends that accommodate the fasteners, and have largely ignored adapting to the socket second end. U.S. Pat. No. 4,840,094 to Macor discloses a multiple socket wrench having inner and outer members that are slidably engaged to accommodate a variety of fasteners. However, Macor does not provide for accommodating different sizes of drive tools. U.S. Pat. No. 5,048,379 to Gramera et. al. discloses a double-ended hollow core socket with a first end having a diameter sized to accommodate a first fastener size, and a second end having a different diameter. Again, the socket cannot accommodate various sizes of drive tools.

There are many types of sockets for accommodating various fastener sizes. However, these sockets often overlook the necessity of attachment to the drive tool. Thus, there remains a need for an adapter to accommodate at least two separate sizes of drive tools and/or socket second ends.

SUMMARY OF THE INVENTION

The present invention allows for a single tool to accommodate a number of different sizes of tools and different sizes of adapters. Existing tools currently on the market may be used and are interchangeable with the tools described in the present invention. In one embodiment, the invention is an adapter for receiving at least two separate sizes of tools.

The adapter has a first adapter end having an inwardly extending cavity with at least two substantially rectangular cross-sectional areas including a distal cavity having a smaller diameter than a proximal cavity. A second adapter end is positioned opposite the first adapter end.

In another embodiment, the invention includes a tool adapter having a first receiving end having substantially rectangular outer and inner cavities. A second extension end is positioned opposite the first receiving end and includes outer and inner extensions being substantially rectangularly shaped.

In another embodiment, the adapter includes a first end having at least two axially aligned receiving cavities. A first receiving cavity is positioned proximate the first end and has a larger diameter than a second distal receiving cavity. A second end has at least two receiving cavities axially aligned. A third receiving cavity is positioned proximate the second end and has a larger diameter than a fourth distal receiving cavity.

A drive tool embodiment is also disclosed having a handle, and a head positioned at one end of the handle. At least two extensions extend outward from the head including a first inner extension having a substantially rectangular shape, and an outer extension centered on the inner extension and having a substantially rectangular shape having smaller dimensions than said inner extension.

DETAILED DESCRIPTION OF THE INVENTION

Figure 1:
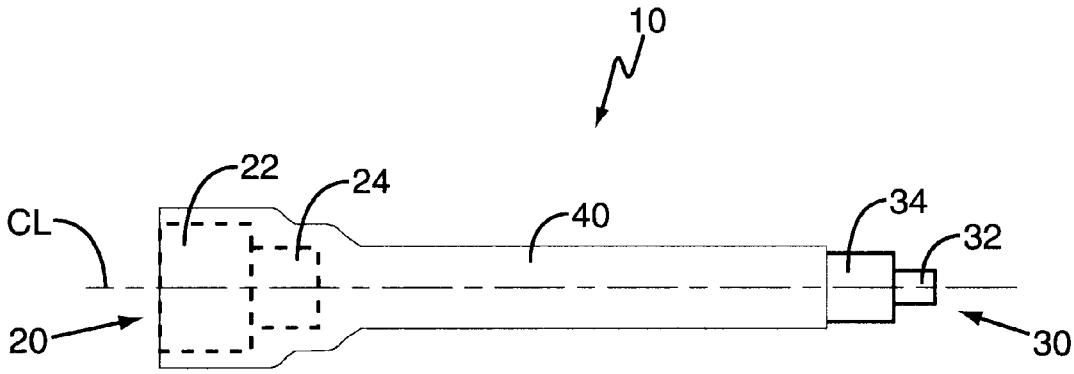
FIG. 1 is a side view with hidden lines of one embodiment of an adapter constructed in accordance with the present invention.
Figure 3:
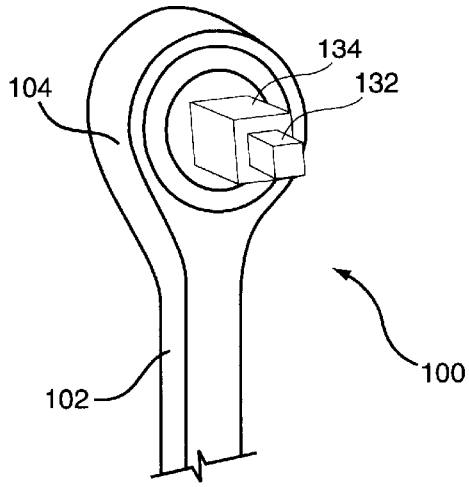
FIG. 3 is a partial perspective view of a drive tool.

Referring now to the drawings and general in FIG. 1 in particular, it will be understood that the illustrations are for the purpose of describing a preferred embodiment of the invention and are not intended to limit the invention thereto. As seen in FIG. 1, an adapter, generally designated 10, is shown constructed according to one embodiment of the present invention. The adapter 10 includes a receiving end 20 having an outer cavity 22 and an inner cavity 24. Positioned on the opposite end, extension end 30 includes an outer extension 32 and an inner extension 34. The adapter 10 provides for mounting a variety of different sized sockets and other like tools onto a single drive tool 100 (FIG. 3).

Receiving end 20 includes at least two cavities for mounting to at least two different sized drive tools or adapters. Preferably, both the outer cavity 22 and inner cavity 24 are aligned along the center line CL as illustrated in FIG. 1. The outer cavity 22 has a larger diameter than inner cavity 24 such that a smaller drive tool that does not mount within the outer cavity 22 can extend into the inner cavity 24. For example, the outer cavity 22 could have an effective diameter of ⅜" and the inner cavity 24 have an effective diameter of ¼". Larger or smaller variations on this are possible, with the limiting criterion being that the inner cavity 24 have a smaller effective diameter than the outer cavity 22. In one embodiment, both inner and outer cavities 22, 24 have substantially rectangular shapes to conform to the drive tool or adapter extensions. The depth of the cavities 22, 24 may vary depending upon the specific embodiments. Ball detent receivers (not illustrated) may also be positioned within the cavities 22, 24 for receiving a ball detent from the drive tool. Additionally, square shapes are specifically contemplated as being included in the rectangular shapes described.

Body section 40 extends between the receiving end 20 and extension end 30. Again, the body may have a variety of dimensions and sizes depending upon the desired usage of the adapter 10. As illustrated in FIG. 1, body 40 has an elongated shape which has substantially the same diameter throughout the length. Body 40 may be substantially solid or may be hollow to reduce the amount of material necessary during manufacturing.

Extension end 30 includes extensions 32, 34 for mounting into sockets or other like tools. Inner extension 34 has a larger cross-sectional span than outer extension 32. This configuration allows for the outer extension 32 to mount into smaller sized receptacles such as a complementary inner cavity 24 on a second adapter 10 without being blocked by the larger outer cavity 22. In an exemplary embodiment, both inner and outer extensions 34, 32 are substantially rectangular-shaped for mounting into the different sizes of sockets. The length of the inner and outer extensions 34, 32 may vary depending upon the specific embodiment. For example, the outer extension 32 may have an effective span of ¼" and the inner extension 34 have an effective span of ⅜", each with a depth of ¼". As with the receiving end, the inner and outer extensions 34, 32 are preferably coaxially aligned on the centerline CL. A ball detent (not illustrated) may be positioned along the extensions 32, 34 for maintaining the socket or tool adapter. The length of the extensions 32, 34 may vary depending upon the specific environment in which the tool is used. This variance may be from the exemplary ¼" described for both depths, or the depths may vary independently of one another.

It is possible that the adapter 10 of FIG. 1 may include only one cavity 22 and two extensions 32, 34 or two cavities 22, 24, and only one extension 32. The variety of combinations possible is one of the things that makes the present invention versatile and desirable to those who use these sorts of tools as they may mix and match as they need to to accommodate their needs.

Figure 2:
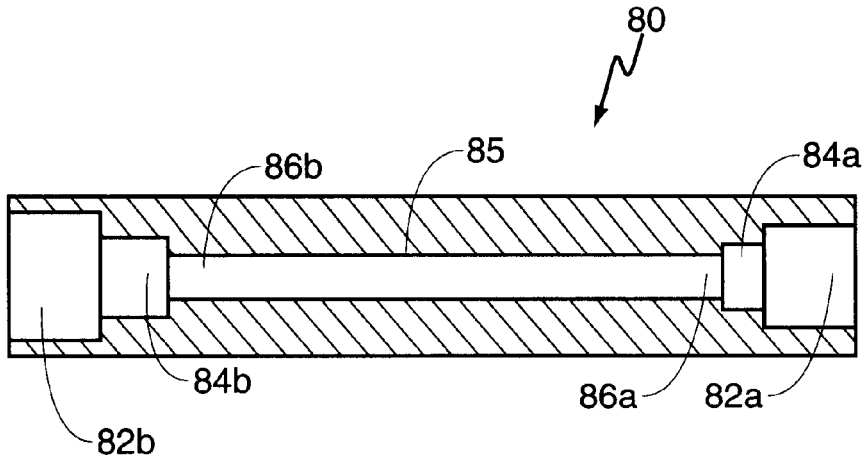
FIG. 2 is a cross-sectional side view illustrating a socket constructed according to one embodiment of the present invention.

FIG. 2 illustrates another adapter 80 of the present invention having two receiving ends each of different sizes. By way of example, a first side 84*a*, 86*a* may be sized for a drive tool size produced by a first manufacturer, and the second side 84*b*, 86*b* sized in accordance with another manufacturer. Alternatively, the two sides may be equipped for the same manufacturer and each be of a different size to increase the likelihood of mounting to the drive tool. In another embodiment illustrated in FIG. 2, the inner receiving cavities 86*a*, 86*b* may extend through the length of the adapter 80 and connect forming a substantially hollow interior. The inner receiving cavities 86*a*, 86*b* may be of the same size, or may be of differing sizes. The adapter 80 illustrated in FIG. 2 allows for a single adapter 80 to be used on a variety of drive tools 100 (FIG. 3) to reduce the amount of tools necessary for the user to handle and purchase.

Figure 4:
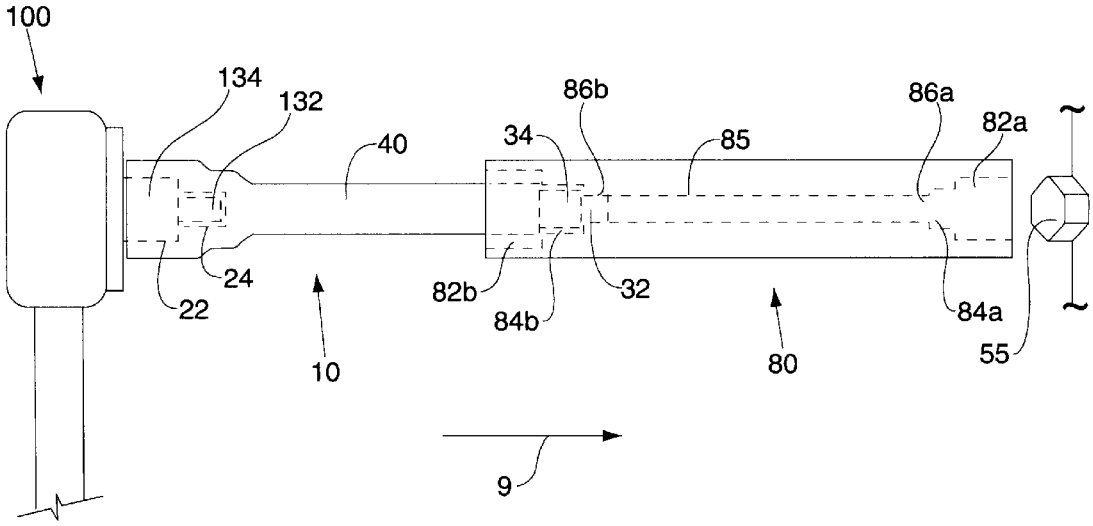
FIG. 4 is a side view with hidden lines of the drive tool with attached adapter and socket mounted together in accordance with one embodiment of the present invention.

Adapter 80 may further include one or more socket adapters 82*a*, 82*b* positioned along an exterior edge of end. Each socket adapter 82*a*, 82*b* is sized to mount over a fastener 55 (FIG. 4). In one embodiment, socket adapters 82*a*, 82*b* are centered about the adapter center and are hexagonal to mate with a standard multi-sided bolt head. Additionally, more than one different sized adapter may be mounted on each end. Thus, a first end socket adapter 82*a* may be sized to accommodate ½" fasteners and the second end socket adapter 82*b* may be sized to accommodate a 12 mm fastener.

The drive tool 100 is illustrated in FIG. 3. Drive tool 100 includes a handle 102 and a head 104 having a plurality of extensions 132, 134 extending outwardly therefrom. The extensions 132, 134 are of different sizes to accommodate a variety of sockets or adapters, and are substantially identical to the extensions 32, 34 on the adapter 10. However, the extensions 132, 134 are mounted on a ratchet mechanism that mounts within the head 104 for rotation in a clockwise and counter-clockwise directions as is well known to one skilled in the art. Extensions 132, 134 are preferably substantially rectangular shaped to conform to the sockets and adapters.

FIG. 4 illustrates the drive tool 100 with a first adapter 10 and second adapter 80. The drive tool inner extension 134 is sized, within this embodiment, to be received by the outer cavity 22 of the first adapter 10. The first adapter outer extension 32 is sized to fit within the inner receiving end 86*b* of the second adapter 80 and not interfere with the mounting. As the drive tool 100 and attached first adapter 10 are moved in the direction of arrow 9, the outer extension 32 is sized to mount into the inner cavity 86*b* of the second adapter 80. The second adapter outer receiving end 84*b* and socket adapter 82*b* are of a large enough size so as not to interfere. The second adapter socket 82*a* is sized to accommodate the fastener 55. Rotation of the drive tool 100 is transferred through the first and second adapters 10, 80 for rotating the fastener 55. It should be appreciated that while one mating arrangement between the elements are shown, other permutations are contemplated wherein the drive tool 100 fully mates with the first adapter 10 and the first adapter 10 only partially mates with the second adapter 80.

It should be noted that the second adapter socket 82*a* may not be sized to accommodate the fastener 55, thereby requiring the second adapter 80 to be reversed such that the second socket 82*b* may accommodate the fastener 55, or another second adapter may be placed on the first adapter 10 as necessary. Additionally, the second adapter 80 may be sized to be mounted directly to the drive tool 100.

Figure 5:
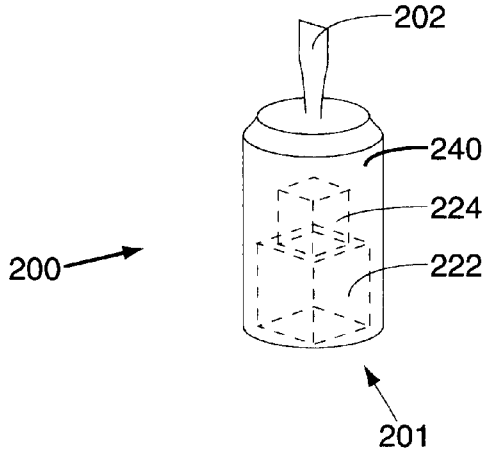
FIG. 5 is a perspective view with hidden lines illustrating an alternative tool adapter embodiment having a receiving end and a tool end.

FIG. 5 illustrates an alternative embodiment of a tool adapter 200. Tool adapter 200 includes a first receiving end 201 having at least two cavities 222, 224 for receiving extensions 32, 34, 132, or 134 similar to the adapter 10 or drive tool 100. A second tool end 202 features a tool fixedly mounted to the body 240. This design allows for the drive tool 100 to be used as a rotational tool. Tools that may be positioned on the second tool end 202 include a screwdriver, universal joint, hex driver, spark plug socket, open-ended wrench, posi-drive wrench, ALLEN wrench, TORX wrench, and the like. One skilled in the art will understand that there are other numerous other tools that may be mounted to the tool adapter 200. The body 240 may have a variety of orientations depending upon the desired positioning of the tool.

Figure 6:
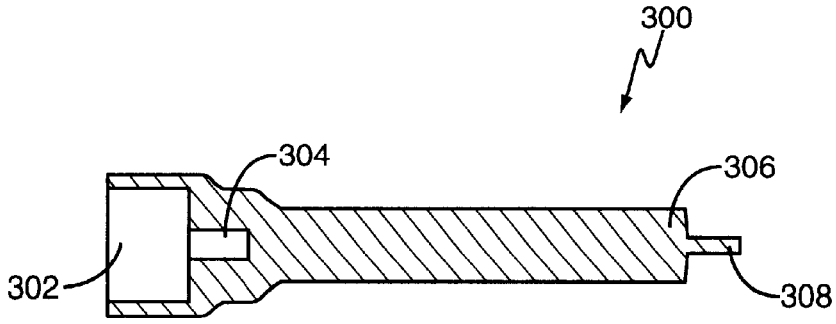
FIG. 6 is a cross-sectional side view of yet another alternate embodiment of an adapter and FIG. 7 is a cross-sectional side view of another embodiment of the present invention.

In addition to using a tool adapter 200 so that the drive tool may be converted into a different rotational tool, it is possible to modify the cavities and extensions of any of the adapters 10, 80 or tools 100, 200. In particular, any outer extension 32 may be modified such that it is in fact a tool end comparable to tool end 202, and any interior cavity 24, 84*a*, 84*b*, 86*a*, 86*b*, or 224 may be modified to receive such a tool end type extension. Thus, for example as shown in FIG. 6, an adapter 300 includes an outer rectangularly shaped cavity 302 and an inner ALLEN wrench shaped cavity 304. Further, the adapter 300 includes a rectangularly shaped inner extension 306 and an ALLEN wrench shaped outer extension 308. Variations of the tool shaped extension cavity 304 and extension 308 are possible both in size and in type of tool end. Thus, as listed above a screwdriver, universal joint, hex driver, spark plug socket, open-ended wrench, posi-drive wrench, ALLEN wrench, TORX wrench, and the like may all be used. Further, it is possible that the outer cavity 302 and inner extension 306 could also be shaped to correspond to a tool end. However, care must be taken that a small tool end is still able to pass through the outer cavity 302 to reach inner cavity 304 and that there are no obstructions. Further, a large cavity must still fit over outer extension 308 to fit properly on inner extension 306. As long as these criteria are met, the tool end type cavities and extensions may be mixed and matched with rectangularly shaped and other tool type cavities and extensions as needed or desired.

Figure 7:
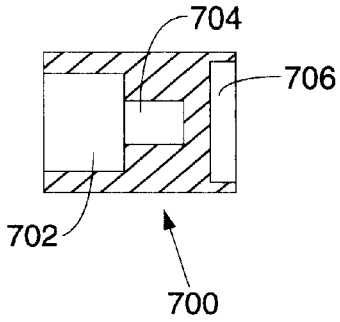

FIG. 7 illustrates another embodiment of the present invention having a first end with a pair of receiving cavities 702, 704, and a second end 706 sized to mount about a fastener 55. This embodiment may be mounted directly to the extensions of a drive tool, and does not require any intermediate device for making a connection. In one embodiment, the depths of the pair of receiving cavities 702, 704 are substantially equal.

The elements of present invention are both preferably constructed of a unitary construction. Preferably, they are constructed of a durable material that resists bending or deformation. In one embodiment, the pieces are constructed of a forged steel.

In the foregoing description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms. The present invention may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A socket comprising:

a body comprising a hexagonal receiving end cavity adapted to receive a workpiece and operate on said workpiece;

said body further comprising a drive tool end cavity comprising an interior shoulder that divides said tool end cavity into a first rectangular portion to receive a first sized polygonally shaped drive tool and a second rectangular portion to receive a second sized polygonally shaped drive tool, said first portion being positioned on an outer end of said body and being wider than said second portion;

wherein a first or second sized rectangular drive tool may be inserted into said drive tool end cavity and turn said body;

wherein the body is solid between an inner end of the second portion and the receiving end cavity.

2. The socket of claim 1, wherein a depth of said first portion is substantially equal to a depth of said second portion.

3. The socket of claim 1, wherein said receiving end cavity and said drive tool end cavity are aligned about a center line.

4. The socket of claim 1, wherein said body is substantially cylindrical in shape.

5. The socket of claim 1, wherein said receiving end cavity is isolated from said drive tool end.

6. A tool comprising:

a drive tool having a rectangular outwardly extending drive shaft;

an adapter comprising:

(i) a first receiving end having an outer and an inner cavity each having a rectangular perimeter, said inner cavity having a smaller diameter than said outer cavity; and (ii) a second end having a single hexagonal cavity, wherein one of said inner and outer cavities being sized to receive said outwardly extending drive shaft;

wherein the body is solid between an inner end of the inner cavity and the single cavity.

7. The tool of claim 6, wherein at least one of said outer and inner cavities comprising a ball detent receiver positioned on an inner wall for receiving a ball detent on said drive shaft.

8. The tool of claim 6, wherein said outwardly extending drive shaft comprises a plurality of extensions extending outwardly therefrom.

9. The socket of claim 6, wherein a depth of said outer cavity is substantially equal to a depth of said inner cavity.

10. The socket of claim 6, wherein said outer and inner cavities of said first receiving end and said single cavity of said second end are aligned about a center line.

11. The socket of claim 6, wherein said body is substantially cylindrical in shape.

* * * * *